United States Patent [19]

McGinnis

[11] Patent Number: 4,896,467

[45] Date of Patent: Jan. 30, 1990

[54] WINDOW WELL COVER

[76] Inventor: Daniel McGinnis, 7921 W. Dooner, Tinley Park, Ill. 60477

[21] Appl. No.: 383,046

[22] Filed: Jul. 21, 1989

[51] Int. Cl.[4] ..... B24B 5/00

[52] U.S. Cl. ..... 52/107

[58] Field of Search ..... 52/107, 37, 169.6, 202; 47/40, 68

[56] References Cited

U.S. PATENT DOCUMENTS 300,654 6/1884 Smith ..... 52/107

3,703,791 11/1972 Slade ..... 52/107

*Primary Examiner*—John E. Murtagh

*Attorney, Agent, or Firm*—Garrettson Ellis

[57] ABSTRACT

A one-piece plastic window well cover comprised of a side wall having upper and lower edges and a bottom wall integrally connected to the side wall adjacent the lower edge, so that the window well cover defines a container. The upper edge of the side wall defines an outwardly extending section which is proportioned to engage the upper edge of the window well so that the bottom wall and at least the majority of the side wall resides within the window well, hanging from the upper edge of the window well. The window well cover may be used as a planter, to provide a decorative or other small garden in place of the unsightly window well.

10 Claims, 1 Drawing Sheet

FIG. 1
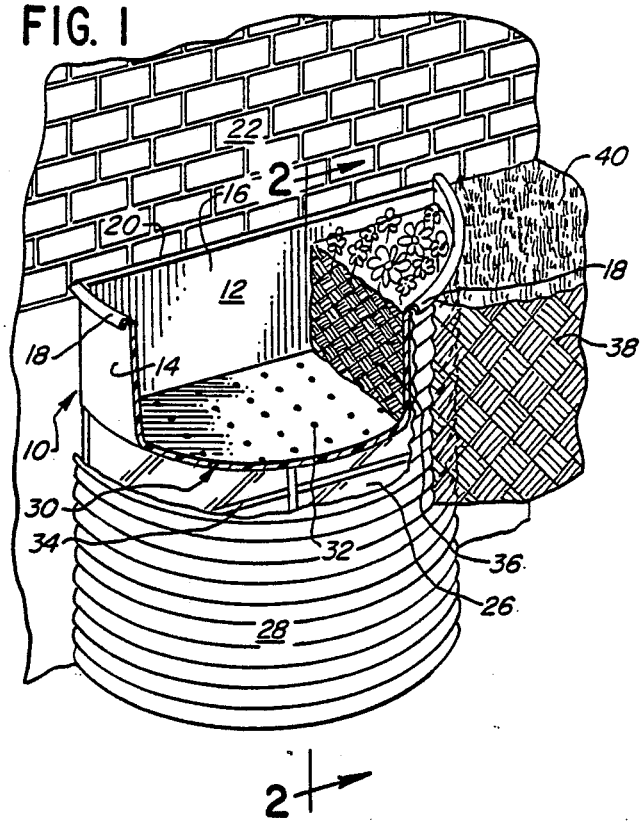
FIG. 2
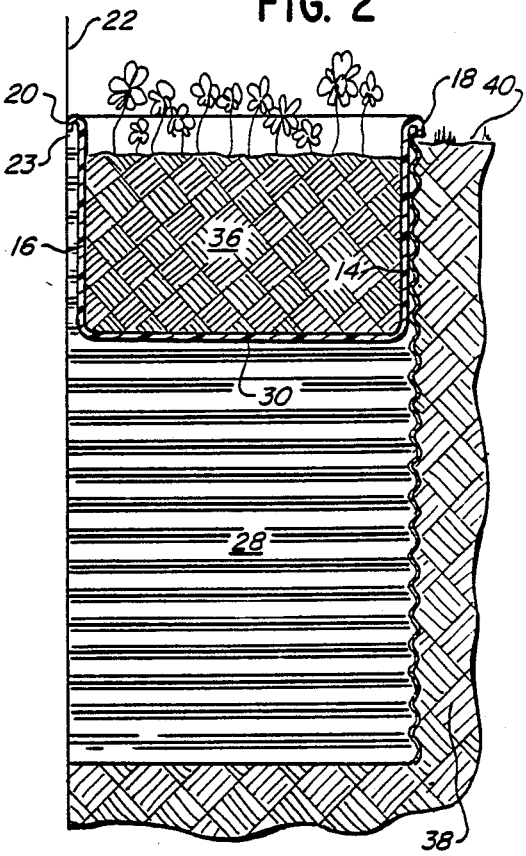
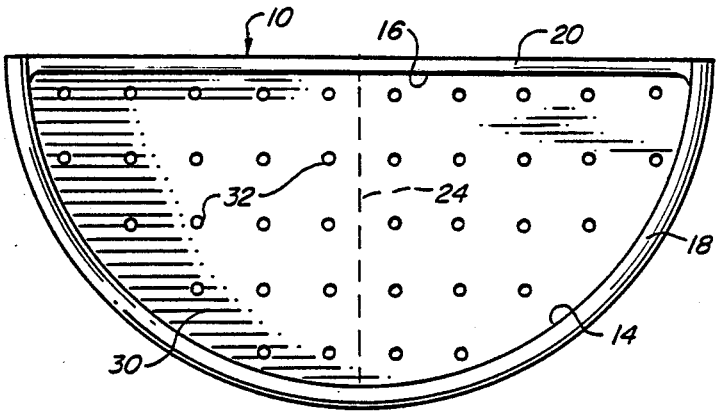
FIG. 3
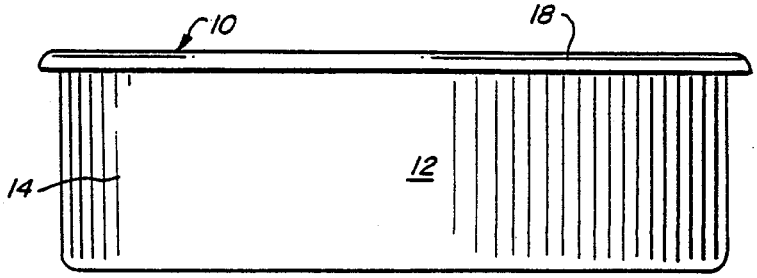
FIG. 4

WINDOW WELL COVER

BACKGROUND OF THE INVENTION

Window wells are found in most homes which have basements. They are typically a semicircular pit, with the outwardly facing sides being defined by a semicircular sheet of corrugated steel, to provide an access opening for a basement window.

Window well covers are currently available in hardware stores, typically comprising either a flat, plastic deck, or a convex, plastic shroud or "bubble" which rests over the window well. The purpose of such covers is to prevent the collection of debris and excess water in the window well, and also to give warning and to protect against accidentally stumbling into the window well.

Window wells and their currently available covers are generally rather unsightly. In accordance with this invention, a window well cover is provided which is capable of providing a great decorative improvement to the surrounding area, yet which still encloses the window well to prevent debris and garbage from falling therein. At the same time, if an emergency escape through the window well from the basement is required, the window well cover of this invention may be simply pushed aside to permit such escape.

DESCRIPTION OF THE INVENTION

In this invention, a one-piece, plastic window well cover is provided which comprises a side wall having upper and lower edges and a bottom wall interconnected adjacent to the lower edge of the side wall. Thus, the window well defines a container with side and bottom walls.

The upper edge of the side wall defines an outwardly extending section which is proportioned to engage the upper edge of the window well, particularly the upper edge of the corrugated steel sheeting that defines the outwardly facing portion of the window well. Thus, when the window well of this invention is hung in place with the outwardly extending section engaging the window well upper edge, the bottom wall and at least the majority of the side wall resides within the window well.

Typically, the bottom wall defines one or more small apertures to permit water drainage from the window well, while substantially retaining solid materials such as topsoil or other soil of a type that may be used in a planter box. Thus, the window well may be filled with soil and may function as a planter providing a miniature garden in place of an unsightly window well. Thus, an unattractive area of a home may be decorated with beautiful flowers contained in the window well cover of this invention, serving as a planter box.

At the same time, the basic functions of a window well cover may still be provided in that significant amounts of debris cannot fall into the window well. Also, removal of the window well cover filled with dirt from the outside is difficult, which hampers break-ins or other unauthorized entry. Nevertheless, if exit through the window well from the basement is mandatory, one can simply shoulder the window well cover aside as one climbs out of the window well.

Typically, the side wall of the window well of this invention is of D-shaped cross section, proportioned to be of almost the same dimensions as the typical semicircular corrugated steel outer wall of the window well.

Preferably, the outwardly rolled section extends along the entire length of the semicircular upper edge of the side wall of such a D-shaped structure. Also, along the straight edge of the side wall a flange or gripping member may be provided, to grip a rib or the like on the wall of the house, if desired.

The side and bottom walls of the window well cover of this invention are preferably made of polyolefin plastic, and are of a thickness to provide the window well cover with the necessary strength to carry the weight of the soil or the like which it may contain while in place. Typically, the thickness of the plastic walls is at least about one eighth inch.

DESCRIPTION OF DRAWINGS

In the drawings, FIG. 1 is a perspective view, with portions broken away, of one embodiment of window well cover of this invention in its intended position of mounting in a window well;

FIG. 2 is a sectional view taken along line 2—2 of FIG. 1;

FIG. 3 is a top plan view of the window well cover of this invention prior to installation; and FIG. 4 is an elevational view of the window well cover of this invention prior to installation.

DESCRIPTION OF SPECIFIC EMBODIMENT

Referring to the drawings, FIGS. 3 and 4 illustrate the one-piece plastic window well cover 10 of this invention. As described, window well cover 10 comprises a side wall 12 which defines a semicircular wall portion 14 and an integral, straight wall portion 16 so that side wall 12 is of D-shaped cross section as shown in FIG. 3.

The upper edge of side wall 14 defines an outwardly extending section 18 which typically may be a thermoformed, integral part of semicircular wall 14, formed by outward rolling. The straight portion 16 of side wall 12 may also have an outwardly rolled upper edge 20, if desired, or, alternatively, an outwardly extending flange to engage a rib or the like which has been placed on the wall 22 of the house, to provide added support for window well cover 10.

For example, the length of straight wall section 16 may be $31\frac{7}{8}$ inches, with the maximum elevation line 24 between semicircular wall 14 and straight wall 16 having a length of about $15\frac{1}{2}$ inches. Such dimensioning provides a one-piece window well cover which is proportioned to fit a standard sized window well 26 and especially the outer, corrugated wall 28 thereof. Rolled upper edge 18 of wall 12 may constitute a semicircular lip of one inch width, so that rolled, outwardly extending section 18 can engage the upper edge of corrugated semicircular wall 28 with ease. Rolled edge 20 of straight wall 16 may also be of similar dimensions, if such a rolled, outer edge is present. Window well cover 18 may be integrally molded out of polyethylene plastic, with side walls 12 and bottom wall 30 having a thickness of about $\frac{1}{8}$ inch to provide sufficient strength to the structure.

As shown in FIGS. 1 and 3, bottom wall 30 is preferably an integrally molded structure with side walls 12, with bottom wall 30 defining a plurality of holes 32. Holes 32 are typically sized on the order of $\frac{1}{8}$ to $\frac{1}{2}$ inch, to permit the draining of water from the window well cover while restricting the passage of solid materials such as the potting soil 36 or other material that may be carried therein, rather in the manner of a hole in the bottom of a flower pot. If desired, the apertures 32 may be limited to areas that are remote from the basement window 34, being preferably limited to an area adjacent the central portions of semicircular wall 14, to minimize the spattering of dirt on the basement window 34 as the water drains through holes 32.

Thus, as shown in FIG. 1, the plastic window well cove of this invention may be hung on the top lip of the corrugated outer wall 28 of the window well. Then it may be at least partially filled with dirt 36. This provides a site for a decorative or other planting of flowers or the like, to provide a major improvement in the decor of the immediate area over that provided by an open window well.

In FIG. 1, it is to be noted that inner dirt 36 and outer dirt 38 and covering grass have been broken away to show the structure of the corrugated outer window well wall 28 and window 34. In actuality, corrugated wall 28 will be buried up to ground level 40.

Thus, the window well cover of this invention can close off a window well in desired manner, while providing a potential transformation of the overall decor of the area from unsightly well and cover to an attractive window box-type garden. The window well cover of this invention is inexpensive to manufacture, and is free of the problems of being blown away by the wind, which is a problem of particularly convex bubble-type window wells. Furthermore, no permanent attachment of any kind is required for the window well of this invention, contrary to what is typical for flat deck window well covers. The window well cover of this invention can be lifted out, particularly by pushing from the inside, but it can be removed only with significant difficulty from the outside when filled with dirt to deter break ins through the basement.

The above has been offered for illustrative purposes only, and is not intended to limit the scope of the invention of this application, which is defined as in the claims below.

That which is claimed is:

1. A one-piece plastic window well cover, which comprises a side wall having upper and lower edges, and a bottom wall integrally connected to said side wall adjacent said lower edge, whereby said window well cover defines a container, the upper edge of said side wall defining an outwardly-extending section which is proportioned to engage the upper edge of said window well, whereby said bottom wall and at least the majority of said side wall resides within said window well.

2. The window well cover of claim 1 in which said bottom wall defines small aperture means to permit water drainage while substantially retaining solid materials.

3. The window well cover of claim 1 in which said side wall is of D-shaped cross section.

4. The window well cover of claim 1 which is carried on a window well and is filled with soil, to function as a planter.

5. The window well cover of claim 1 in which said side and bottom walls are made of polyolefin plastic and are of a thickness of at least about $\frac{1}{8}$ inch.

6. A one-piece plastic window well cover, which comprises a side wall having upper and lower edges, and a bottom wall integrally connected to said side wall adjacent said lower edge, whereby said window well cover defines a container, the side wall of said window well cover being of D-shaped cross section, the upper edge of said side wall defining an outwardly-extending section which is proportioned to engage the upper edge of said window well, whereby said bottom wall and at least a majority of said side wall resides within said window well, said bottom wall further defining small aperture means to permit water drainage while substantially retaining solid materials.

7. The window well cover of claim 6 in which said side and bottom walls are made of polyolefin plastic and are of a thickness of at least about $\frac{1}{8}$ inch.

8. The window well cover of claim 7 which is carried on a window well, and is filled with soil to function as a planter.

9. The window well cover of claim 8 in which said outwardly-extending section is an outwardly-rolled section of said side wall.

10. The window well cover of claim 8 which is proportioned to engage the upper edge of a standard corrugated steel outer wall of a window well.

* * * * *